US005117844A

United States Patent [19]

Spicer

[11] Patent Number: 5,117,844

[45] Date of Patent: Jun. 2, 1992

[54] APPARATUS FOR TREATING TOBACCO

[75] Inventor: John W. Spicer, Winchester, England

[73] Assignee: GBE International PLC, Andover, England

[21] Appl. No.: 623,979

[22] PCT Filed: May 2, 1990

[86] PCT No.: PCT/GB90/00679

§ 371 Date: Jan. 10, 1991

§ 102(e) Date: Jan. 10, 1991

[87] PCT Pub. No.: WO90/13231

PCT Pub. Date: Nov. 15, 1990

[30] Foreign Application Priority Data

May 4, 1989 [GB] United Kingdom ..... 8910279

[51] Int. Cl.[5] ..... A24B 63/06

[52] U.S. Cl. ..... 131/109.1; 131/306; 131/305

[58] Field of Search ..... 131/109.1, 305, 306; 34/50, 59, 60, 134, 135, 139

[56] References Cited

U.S. PATENT DOCUMENTS

| | | | |
|---|---|---|---|
| 519,637 | 5/1894 | Marburg | 131/305 |
| 4,884,587 | 1/1991 | Neville | 131/305 |

FOREIGN PATENT DOCUMENTS

| | | | |
|---|---|---|---|
| 0536337 | 1/1959 | Belgium | 131/305 |
| 101271 | 2/1984 | European Pat. Off. . | |
| 159836 | 10/1985 | European Pat. Off. . | |
| 0282845 | 1/1915 | Fed. Rep. of Germany | 131/305 |
| 616819 | 6/1935 | Fed. Rep. of Germany . | |
| 1432589 | 1/1969 | Fed. Rep. of Germany . | |

*Primary Examiner*—V. Millin
*Assistant Examiner*—Lynne A. Reichard
*Attorney, Agent, or Firm*—Dowell & Dowell

[57] ABSTRACT

An apparatus for conditioning tobacco which includes a cylinder conditioner mounted for rotation about a generally horizontal axis, and an opening unit mounted at the inlet end of the cylinder for rotation therewith, and wherein the opening unit has pins projecting towards the axis of rotation for supporting portions of unopened layers of tobacco within the unit on initial entry thereof, and for effecting opening of the tobacco on rotation of the unit with the distal ends of the pins defining a frustoconical section which narrows in the direction of tobacco feed.

11 Claims, 2 Drawing Sheets

APPARATUS FOR TREATING TOBACCO

BACKGROUND OF THE INVENTION

This invention relates to an apparatus for opening tobacco in the form of blocks of un-opened layers and for conditioning tobacco taken from bales prior to a further treatment or processing.

HISTORY OF THE RELATED ART

Direct cylinder conditioning is widely used in the tobacco industry to open and condition compressed bales of threshed or stripped tobacco. The process involves sliding the bale either vertically or horizontally into slabs or slices which are then transported directly to the cylinder for opening and conditioning.

Conditioning cylinders which are used for conditioning of sliced bales of tobacco typically take the form of a cylinder mounted for rotation about a slightly inclined axis, being supported by means of two track rings and cooperating support rollers. The moisture and heat for the opening process in the cylinder are provided by water and live steam sprays, mounted at the inlet end of the cylinder, protruding through a diffusion plate perpendicular to the axis of rotation, or in the recirculating duct which conveys vapour from the outlet of the cylinder back to the inlet where it passes through the diffusion plate back into the main body of the cylinder.

Within the body of the cylinder there are inwardly projecting radial pins of nominal mean length of 100 mm. The remainder of the internal geometry is configured with the pins either linearly, or helically displaced along the length of the cylinder, or with a combination of pins and paddles.

SUMMARY OF THE INVENTION

An object of this invention is to provide an apparatus in which an optimally configured conditioning gas stream can be mixed and distributed evenly over the maximum surface area of a slice of unconditioned tobacco in a conditioning cylinder. The gas stream consists of a mixture of air, steam, water droplets or other absorbable fluids required to bring the tobacco to the desired condition in the cylinder.

According to the present invention there is provided apparatus for opening tobacco in the form of un-opened layers and for conditioning the tobacco comprising a cylinder conditioner mounted for rotation about a generally horizontal axis, and a tobacco opening unit mounted at the inlet end of the cylinder for rotation therewith, said opening unit having projections extending towards the axis of rotation adapted for supporting portions of the un-opened layers of tobacco within the unit on initial entry thereof, and for effecting opening of the tobacco on rotation of the unit, the distal ends of the projections defining a solid revolution which narrows in the direction of tobacco feed.

Preferably the projecting means are in the form of tines, the ends of which describe a frusto-conical section.

In order to promote a fuller understanding of the above and other aspects of the present invention an embodiment will now be described, by way of example only, with reference to the accompanying drawings in which:

DESCRIPTION OF THE PREFERRED EMBODIMENT

Figure 1:
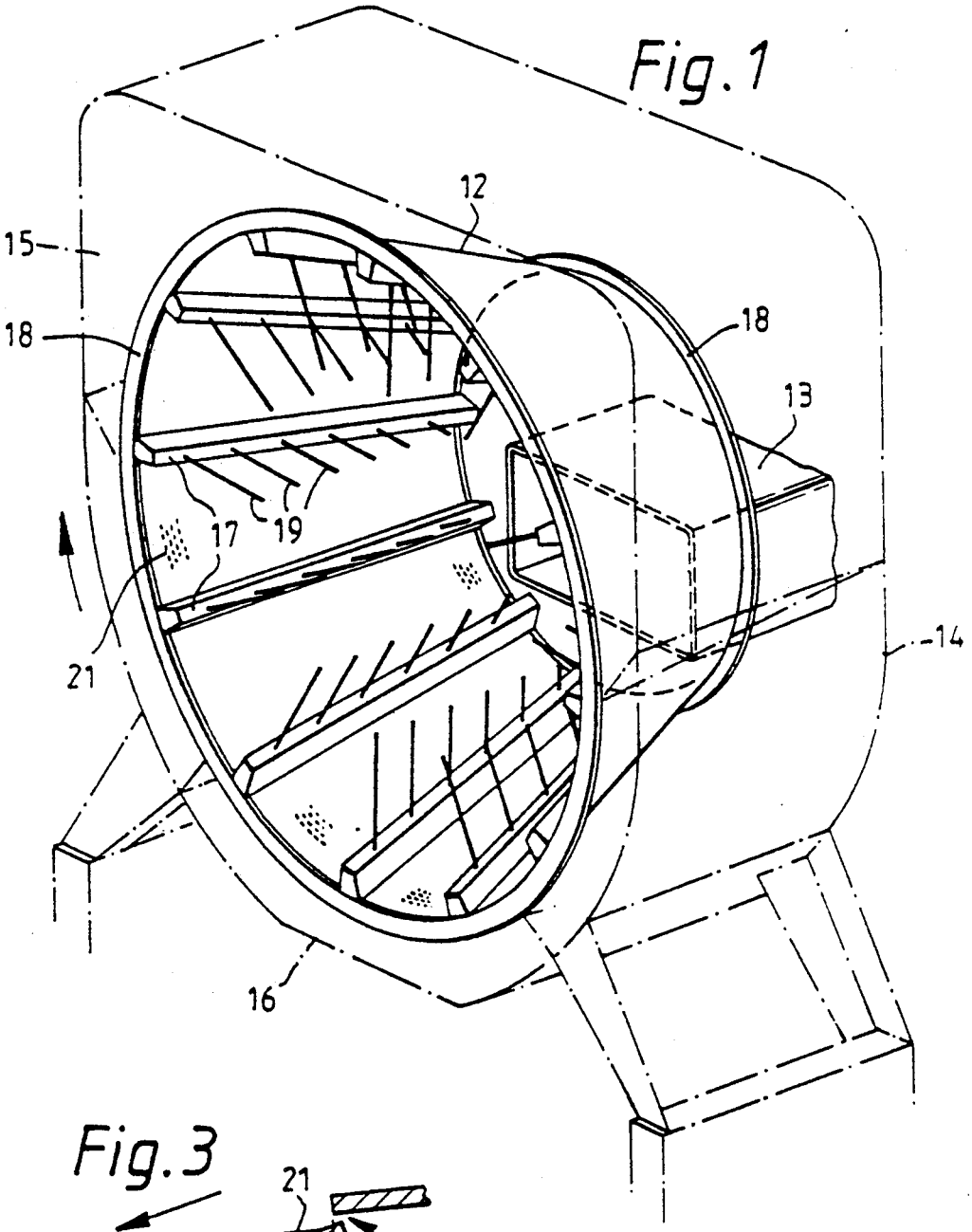
FIG. 1 is a schematic perspective view of an embodiment of the invention.

In the drawings the basic cylinder of a cylinder conditioner is shown at 10 in schematic outline only, and is arranged to rotate in known manner per se about an inclined axis 11 (FIG. 2) inclines to the horizontal leg 3°-5°.

An opening or inlet unit 12 is fitted to the inlet end of the cylinder 10 to rotate therewith. An inlet tunnel 13 for a tobacco slice is arranged at the smaller inlet end of the frusto-conical inlet unit 12, to feed slices of tobacco from means (not shown) which produces such slices from bales of raw tobacco material.

The unit 12 is contained within a stationary jacket 14 which is partitioned to provide an air supply compartment 15 and a steam supply compartment 16. A frusto-conical wall 21 of the unit 12 serving as guide means for the opened tobacco is perforated so that air and steam from the compartments 15 and 16 can enter the unit 12 and pass thence to the cylinder 10 mixing as they so pass.

Figure 3:
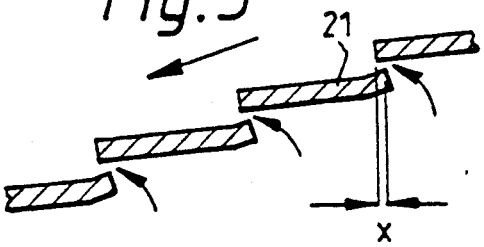
FIG. 3 is a detail cross-section of the perforated cone of FIG. 1.

The perforations in the wall 21 of the unit 12, are formed as louvres, preferably having triangular or semi-elliptical cross section (not shown), with the edges of the louvre overlapping the parent wall edge, as indicated at X (see FIG. 3). By this means the air and steam flow is directed towards the cylinder 10 and particles of tobacco are substantially prevented from falling into the perforations. Any particles which do fall into the perforations are ejected by the fluid flow towards the cylinder 10.

Figure 2:
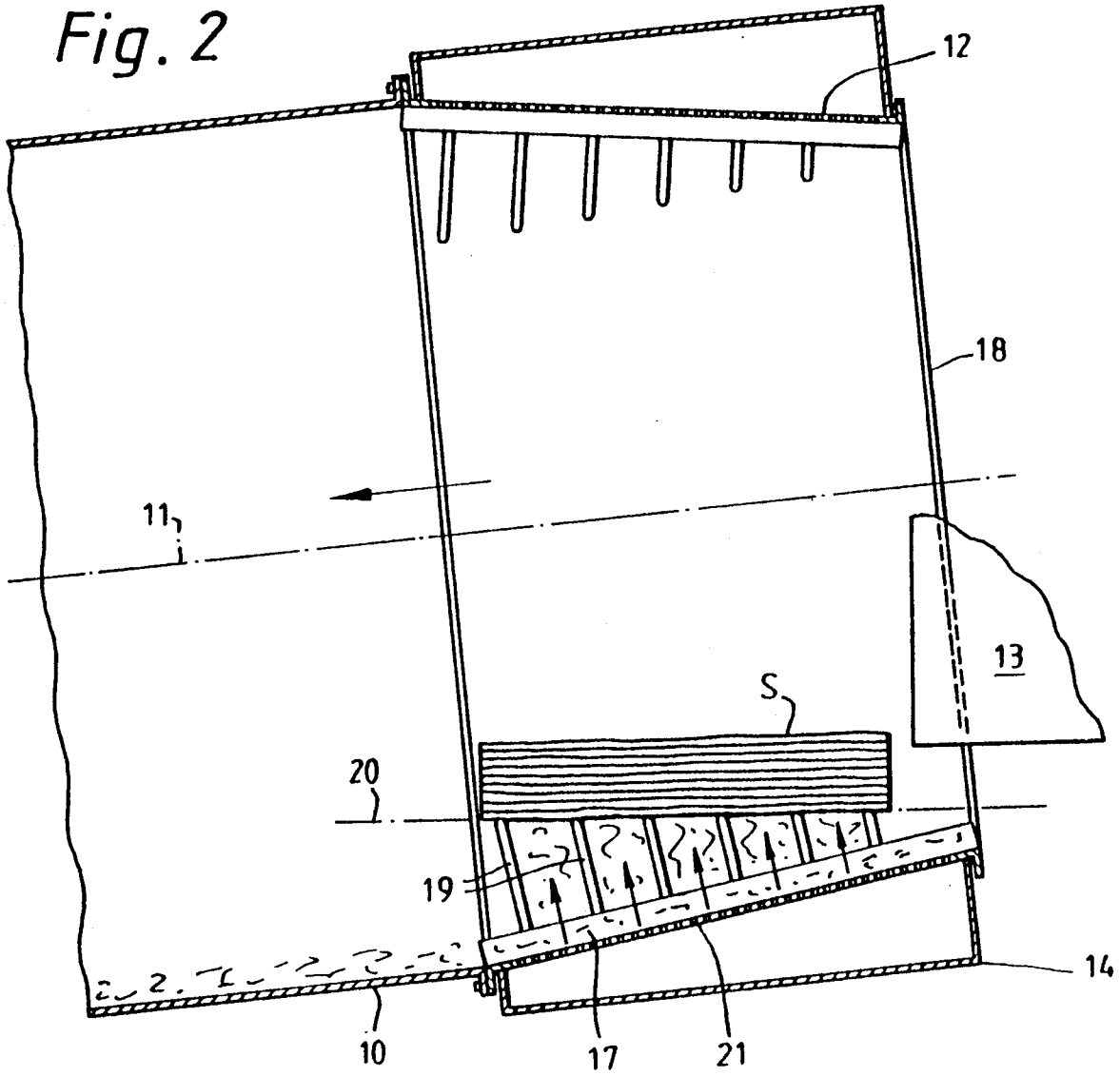
FIG. 2 is a detail cross-section of the line 2—2 of FIG. 1.

A series of bars 17 are provided along generators of the unit 12, between the junction with the cylinder 10 and the inlet end of the inlet section. The bars 17 mounted between rings 18 of different diameters, each support a series of pins or tines 19 which are progressively shorter from the cylinder to the inlet end, so that, as best seen in FIG. 2, the tops of the pins 19 on a bar, when it is at the lowest position during rotation of the cylinder and unit, lie in a generally horizontal line as indicated at 20. Thus when a slice of tobacco as indicated at S has been fed into the inlet unit 12, as the unit rotates the slice is supported at the bottom of the unit on the tops of the pins 19. On rotation of the unit with the cylinder the tobacco is agitated by the pins gradually releasing small parts of the tobacco which can then fall between the pins and progress to the cylinder 10; while the remaining bulk of the slice remains in the unit 12 on the pins 19. Thus the progress of the material of the slice is impeded until it is adequately opened for further conditioning.

Arrangement of the tines such that their tops lie in a generally horizontal line, creates the situation of a very long transit time for tobacco supported by the pin tips. However, once the tobacco has opened sufficiently to pass between the pins, the speed advance into the main body of the cylinder is increased due to conical guide. Means comprising perforated stainless steel sheet, the holes in which being such as to form a louvre-type configuration thereby ensuring directionality of flow toward the cylinder and preventing the passage of tobacco particles back into a surrounding jacket where the mixing vapour is formed, the high afflux velocity achieved by the perforations driving out any particles that enter the perforations.

By selection of the angle of the cone frustum and length of tines transit times for these particles can be changed.

The dimensions of the frusto-conical section generated by the pins are selected in relation to the dimensions of bale slices so that the minor diameter is greater than the width of the slice of tobacco required to enter the cylinder conditioner and the major diameter of which is equal to the nominal diameter of the cylinder as determined by the volumetric throughput of tobacco to be conditioned.

The axial length of the frusto-conical section is preferably up to twice the length of the longest bale slice to be opened.

The number of bars supporting the pins is determined by the requirement of ensuring that the circumferential distance between bars is less than the width of the slice to be opened.

Since the axis of the wall 21 of the opening unit is inclined together with the cylinder, the wall may be cylindrical e.g. of a diameter equal to the diameter of the cylinder. However, to increase the speed of flow after opening, the wall is frusto-conical.

I claim:

1. Apparatus for opening tobacco in the form of unopened layers and for conditioning the tobacco, comprising a cylinder for rotation about a generally horizontal axis, said cylinder having an inlet end, a tobacco opening unit mounted at the inlet end of the cylinder for rotation therewith, said opening unit having projecting means extending towards the axis of rotation and having distal ends adapted for supporting portions of the unopened layers of tobacco within the unit and for effecting opening of the tobacco on rotation of the unit, the distal ends of the projecting means defining a solid of revolution which narrows in the direction of tobacco feed from the opening unit toward the cylinder.

2. Apparatus according to claim 1, wherein the distal ends of the projecting means define a frusto-conical section.

3. Apparatus according to claim 1 or 2 wherein the projecting means are pins or tines.

4. Apparatus according to claim 3, wherein said pins or tines are arranged on bars extending axially of the unit.

5. Apparatus according to claim 4 wherein said bars are inclined to diverge from the axis in the direction of feed.

6. Apparatus according to claim 5 wherein the bars are supported at their ends on rings of different diameters.

7. Apparatus according to claim 1, wherein exteriorly of said projecting means there is provided a frusto-conical guide which widens in the direction of feed, whereby the opened tobacco which has been opened by the projecting means passes radially between them, travels down the frusto-conical guide into the cylinder.

8. Apparatus according to claim 7, in which the axis of rotation is inclined to the horizontal so that the opened tobacco, after being guided down the frusto-conical guide, progresses by gravity along the cylinder.

9. Apparatus according to claim 8, wherein the projecting means have lengths which increase along the opening unit in the direction of feed such that the distal ends thereof, when positioned at the lower part of the opening unit, lie in a generally horizontal line.

10. Apparatus according to claim 7, wherein a steam jacket is provided to surround the frusto-conical guide, the guide having perforations through which steam passes from the jacket.

11. Apparatus according to claim 10, wherein the perforations are provided by a louvre-type configuration to guide steam in a direction to assist the tobacco feed.

* * * * *